US006062910A

United States Patent [19]

Braquet et al.

[11] Patent Number: 6,062,910

[45] Date of Patent: May 16, 2000

[54] CAPACITIVE CABLE ADAPTER

[75] Inventors: Henri Braquet, Aspremont; Serge Lorion, La Gaude; Thierry Sordello, Nice, all of France

[73] Assignee: International Business Machines Corporation, Armonk, N.Y.

[21] Appl. No.: 09/318,192

[22] Filed: May 25, 1999

[30] Foreign Application Priority Data

May 28, 1998 [EP] European Pat. Off. ..... 98480036

[51] Int. Cl.[7] ..... H01R 13/66; H01R 33/945

[52] U.S. Cl. ..... 439/620; 439/654; 439/675; 439/578

[58] Field of Search ..... 439/620, 638, 439/578, 675, 654, 579–582

[56] References Cited

U.S. PATENT DOCUMENTS

| | | | |
|---|---|---|---|
| 4,500,159 | 2/1985 | Briones et al. | 439/620 |
| 4,862,311 | 8/1989 | Rust et al. | 439/620 |
| 4,894,630 | 1/1990 | Ueta et al. | 439/620 |
| 5,409,398 | 4/1995 | Chadbourne et al. | 439/620 |
| 5,554,049 | 9/1996 | Reynolds | 439/620 |
| 5,562,499 | 10/1996 | Minich | 439/620 |

*Primary Examiner*—Lincoln Donovan
*Assistant Examiner*—Hae Moon Hyeon
*Attorney, Agent, or Firm*—Bernard D. Bogdon

[57] ABSTRACT

A capacitive cable adapter for providing ground of the same potential at high frequencies for interconnected electrical devices. The capacitive cable adapter, for being interposed between at least two electrical devices interconnected via a shielded cable, comprises two shielded electrical connectors aligned back-to-back with an internal pin-to-pin connection, with the outer shield of each of the two connectors being interrupted approximately at mid distance between the end of the two connectors, thereby forming a gap between the outer protective shield of the two connectors, including a predefined number of capacitive components arranged such that, one of the two pins of each capacitor is connected to the protective shield of one of the two connectors, and the other pin of each capacitor is connected to the shield of the other connector, thereby connecting over the gap the outer shields of the two connectors.

12 Claims, 5 Drawing Sheets

CAPACITIVE CABLE ADAPTER

TECHNICAL FIELD

The present invention relates to RFI shielding and more particularly to a capacitive cable adapter to provide a ground of the same potential at high frequencies for interconnected electrical devices as well as complying with safety requirements, while assuring effective RFI prevention.

DESCRIPTION OF THE PRIOR ART

There are many instances when electrical devices of a system separated by some distance share a physical communication media over which they exchange information signals. The media quite often takes the form of a cable, which usually features at both ends a connector to fit the matching connector implemented in each to-be-connected device. Such a cable between remote electrical devices needs to be radio frequency proof so as not to be perturbated by the inevitable ambient radio waves, such as the ones generated by other surrounding electrical devices. Furthermore, the cable itself must not radiate frequencies to a level higher than a threshold, usually set by national standards, beyond which other surrounding electrical devices could be perturbated. Both phenomena are known under the generic term of "radio frequency interference" (RFI). In order to protect from RFI, the devices are usually encased in a metal frame (or a frame coated with electrically conductive material) set at the local ground potential, and the cable itself comprises a bundle of internal electrical wires sheathed by a shield along the total length. The cable shield is to be connected at both ends to a machine part at the local ground potential so as to ensure electrical continuity. It is indeed in this configuration that the overall connection radiates less and is less susceptible to incident waves.

On the other hand, this electrical continuity is conflicting with safety and functional requirements as the two devices connected at some distance are not necessarily at the same ground potential. Indeed, when there is a potential difference in ground between separated devices, a ground current, commonly referred to as common mode current, will flow through the cable shield which can in turn, interfere with signals, cause a hazard of shock from touching any of the devices, and cause arcing throughout the system. Therefore, the connection between the cable shield and any device part at the ground potential, should feature a high impedance at the industrial frequencies (DC to a few hundreds Hertz and typically 50/60 Hertz). In the prior art, a well-known technique to meet such conflicting requirements consists in soldering one or several capacitors on the matching connector of any to-be-connected device, so as to ensure capacitance between the shield of a plugged-in connector of a cable, and a part (usually the metal frame) of the connected device at the local ground potential. This technique however has the main following drawbacks:

The soldering of capacitors on a connector is neither technically easy nor cheap to realize in a manufacturing line.

Strain on the connector (plug-in, plug-out) might later affect the quality of the soldering.

The capacitors are not geometrically concentric with the cable internal wires, so that mutual coupling between the cable shield and wires is degraded ("pig tail" effect), and the overall shielding effect is ruined. Therefore, especially at high frequencies such as above 10 Megahertz MHZ), influence of RFI is such that corruption of the signals exchanged over the cable is not acceptable or emission exceeds the norms that are to be satisfied.

SUMMARY OF THE INVENTION

The present invention overcomes the above problems by providing a capacitive cable adapter that allows to fully meet electrical requirements regarding radio frequency interference and safety for a connection between two electrical devices.

It is an object of the present invention to provide an improved capacitive cable adapter for providing ground of the same potential at high frequencies for interconnected electrical devices while complying with safety requirements and providing efficient RFI prevention.

In brief, this object is accomplished by providing a capacitive cable adapter intended for being interposed between at least two electrical devices interconnected via a shielded cable. The capacitive cable adapter is interposed such as to remove electrical continuity at low frequencies over the cable shield between the local grounds of the interconnected electrical devices. The cable adapter of the invention comprises two shielded electrical connectors, the two connectors being aligned back-to-back with an internal pin-to-pin connection. The outer shield of each of the two connectors is interrupted approximately at mid distance between the end of the two connectors, thereby forming a gap between the shield of the two connectors. A predefined number of capacitive components are arranged such that, one of the two pins of each of the capacitors is connected to the shield of one of the two connectors, and the other pin of said each capacitor is connected to the shield of the other connector, thereby connecting via capacitors over the gap the outer shield of the two connectors.

The two coupled connectors that form the adapter may either be both male or both female, or be one male and the other female, depending on the type (male/female) of connectors between which the adapter is to be interposed.

The capacitive cable adapter of the invention is interposed between either a connector attached to an electrical device and a connector terminating a shielded cable which connects at its other end at least one another electrical device, or between two connectors respectively terminating a shielded cable that connects at least one electrical device.

The adapter of the invention may be implemented with any type of shielded connectors such as BNC type connectors, DB type connectors, or RJ type connectors. In a first embodiment the capacitive cable adapter of the invention, comprises a couple of BNC electrical connectors the shields of which are connected via a predefined number of SMT capacitors.

In a second embodiment the capacitive cable adapter of the invention includes a couple of DB type connectors the shields of which are connected via a predefined number of SMT capacitors.

The capacitive cable adapter of the present invention provides a common ground potential at high frequencies for electrical devices interconnected via a connection cable, while at the same time assuring electrical discontinuity for low frequencies (DC to a few hundreds Hertz) thereby supplying for safety requirements. But, due to the specific arrangement of the capacitors elements that connect the two back-to-back connectors, the overall shielding structure of the connection cable is capacitors. Accordingly, the radio frequencies prevention is efficiently assured. Finally, corruption of high frequencies signals exchanged over the cable is suppressed as well as undesired emissions.

BRIEF DESCRIPTION OF THE DRAWINGS

Embodiments of the invention will now be described, by way of example only, with reference to the accompanying drawings, wherein.

DETAILED DESCRIPTION OF THE INVENTION

Figure 1:
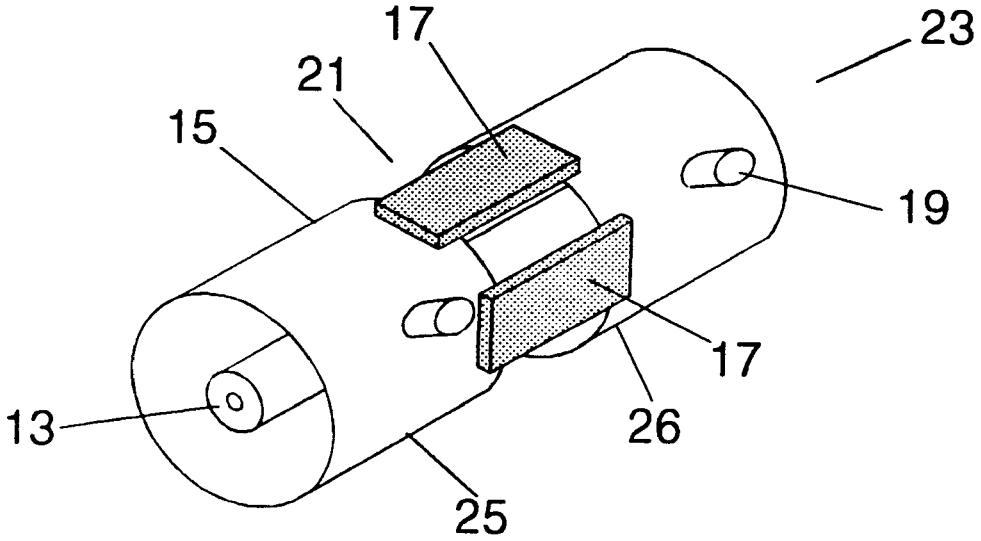
FIG. 1 shows an elevational view of a female-female BNC Type capacitive cable adapter according to the principles of the present invention.

Referring now to the drawings and more particularly to FIG. 1, there is shown a first embodiment of the invention in which the capacitive cable adapter is implemented with two BNC type connectors. In FIG. 1, the capacitive cable adapter 23 includes two female BNC connectors (25, 26) which are aligned and coupled back-to-back with an internal continuity of the core lead 13. The shield 15 over the two connectors' bodies is interrupted approximately at mid length from the adapter ends thereby forming a gap 21. Surface mounted technology (SMT) capacitors 17 are soldered over the gap 21, one pin of the two pins of each capacitor being soldered on the shield of one of the two connectors, the other pin being soldered on the shield of the other connector. For coaxial type connectors, the number of SMT capacitors used is preferably four and at minimum two. For a larger connector type, the inventors consider that a good compromise would be to have one capacitor per curvilinear centimeter but at minimum, one per two centimeters is required to achieve a satisfactory result. As for the capacitive value of the SMT capacitors, tests have shown that suitable values range from 10 nF to 100 nF in the 0603 or 0805 category sizes. In the embodiment of FIG. 1, there are four SMT capacitors (two are hidden), each having a capacitive value of 100 nanoFarads (nF)/500 Volts (V).

Figure 2:
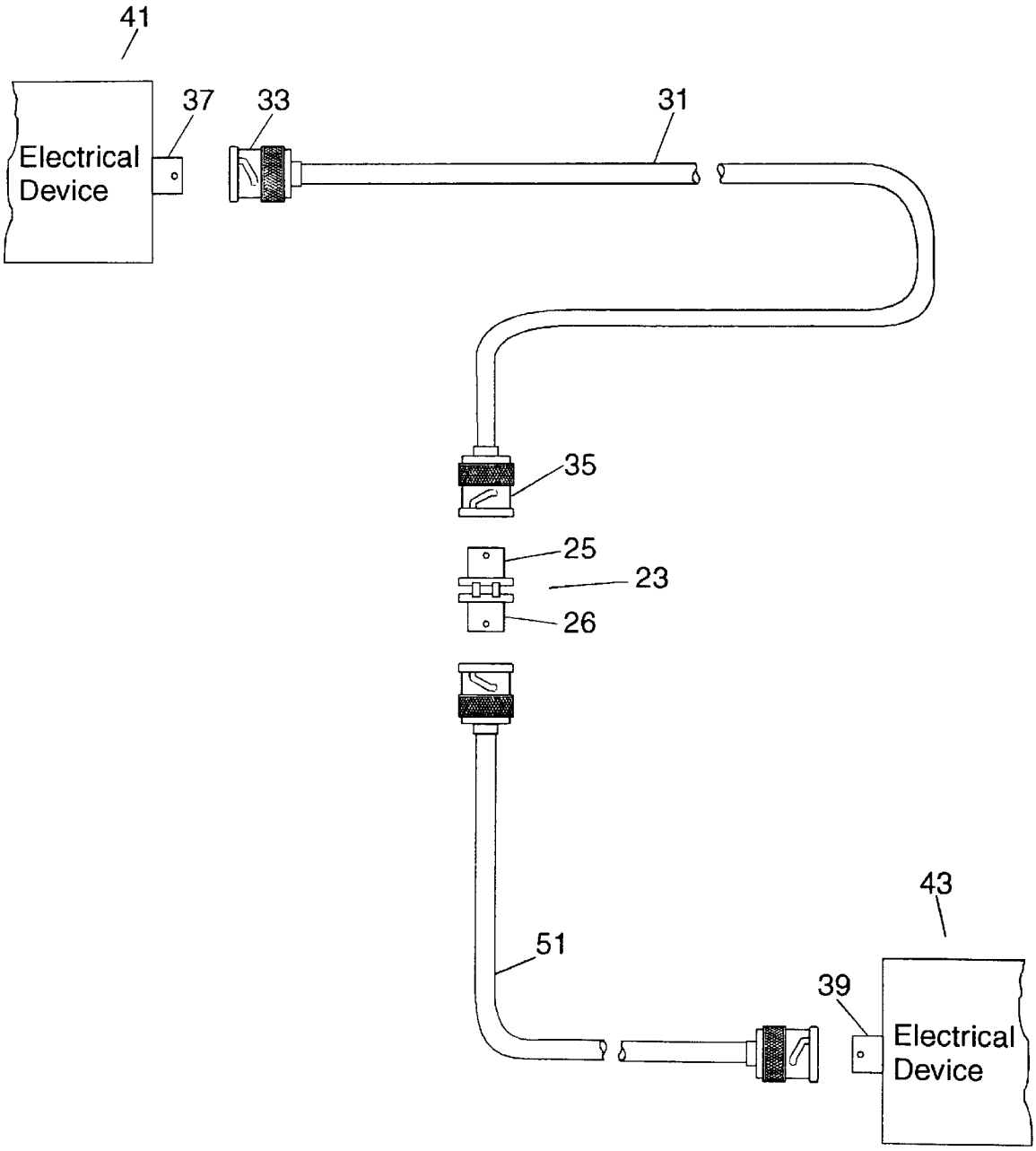
FIG. 2 shows the capacitive cable adapter of FIG. 1 assembled for operation in accordance with the present invention.

The female-female cable adapter of FIG. 1 is intended for connecting a male BNC type connector at each of its ends. For example, in the case when the interconnected electrical devices are interconnected using a BNC shielded coaxial cable which typically comprises one male BNC connector at both ends, the adapter of FIG. 1 is used as described below in connection with FIG. 2. Referring to FIG. 2, the BNC cable 31 is unplugged from the connector 39 on one of the two electrical devices 43 and the shielded capacitive adapter 23 is plugged at one of its ends 25 to the unplugged BNC cable connector 35. Then a second BNC coaxial cable 51 is inserted (plugged) between the connector 26 at the other end of the adapter and the unplugged connector 39 on the electrical device 43.

Figure 3:
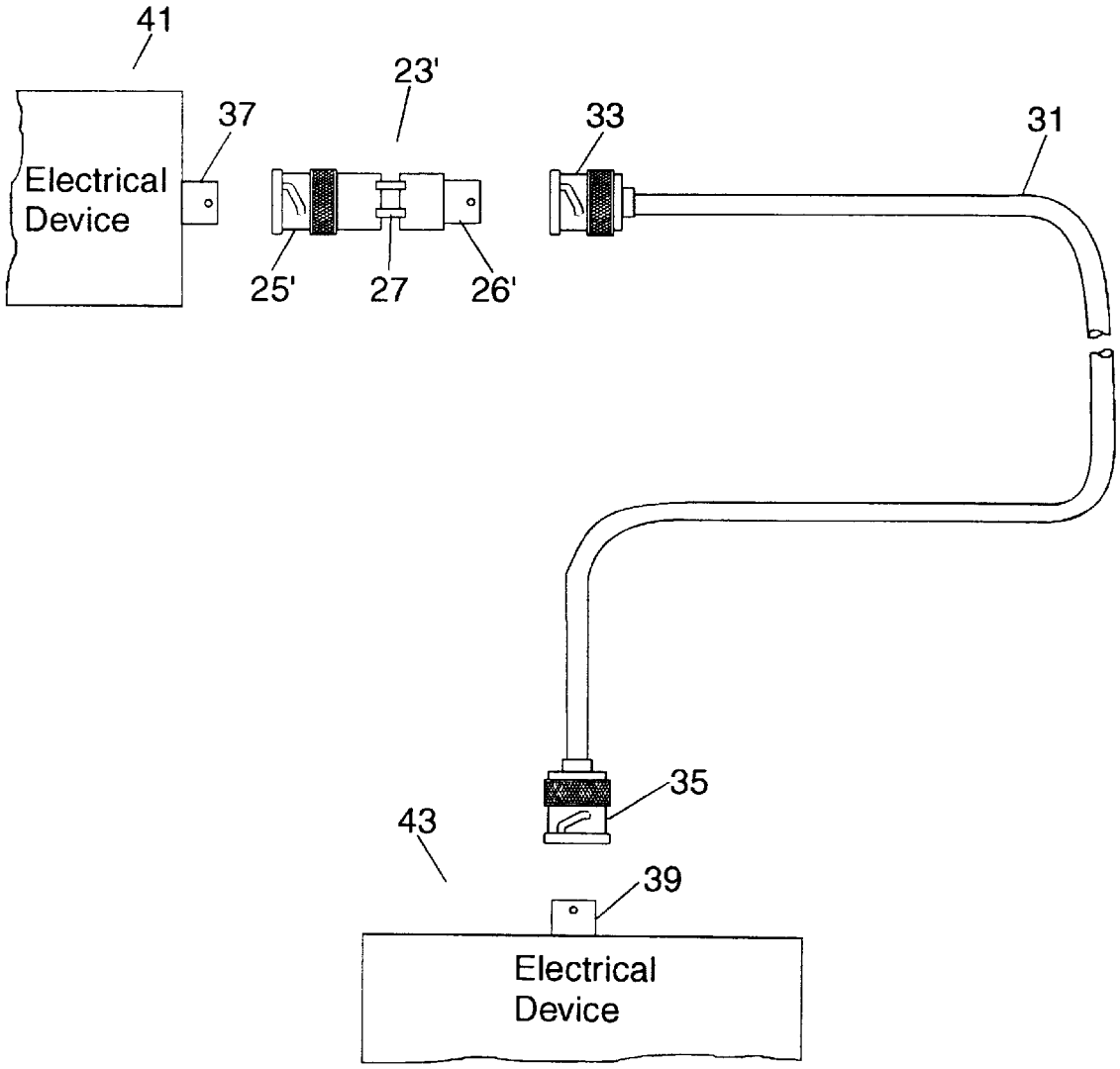
FIG. 3 shows a male-female BNC type capacitive cable adapter assembled for operation in accordance with the present invention.

Alternatively, the capacitive cable adapter of the invention comprises a pair of male-female BNC connectors. As shown in FIG. 3, a male-female capacitive cable adapter 23' according to the invention comprises a male BNC connector 25' coupled to a female BNC connector 26', the shield of which are linked via at least two SMT capacitors 27. Shielded BNC cable 31 was previously connecting electrical devices 41 and 43 through mating, at one end, female BNC connector 37 on device 41 with male connector 33 on cable 31, and at the other end, female BNC connector 39 on device 43 with male connector 35 on cable 31. Male-female adapter 23' of the invention is interposed between connector 37 of electrical device 41 and connector 33 of BNC cable 31.

Figure 4:
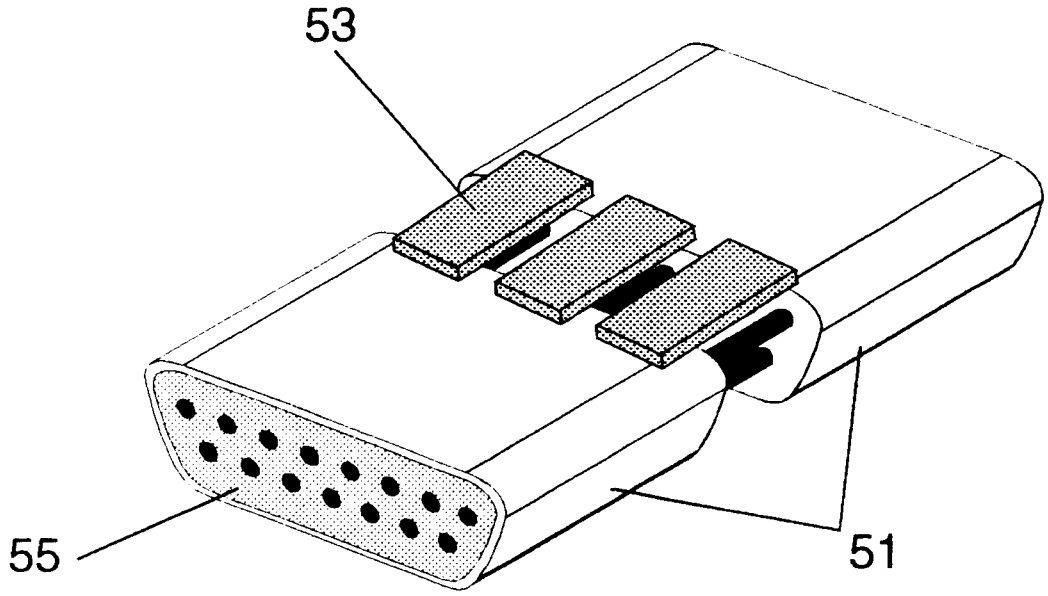
FIG. 4 shows an elevational view of a DB Type capacitive cable adapter according to the present invention.

While the shielded capacitive adapter of the invention is implemented with BNC type connectors in the preferred embodiment, the scope of the invention is not limited to this type of connectors as it is obvious for a skilled person in the art that the invention can be practiced with any type of shielded connectors. For example as shown in FIG. 4, DB type connectors may be used. Referring to FIG. 4, there is shown a shielded capacitive adapter according to the invention implemented with two female DB type connectors 51 assembled back-to-back with their shield connected via SMT capacitors 53 and with internal one-to-one electrical connection between output sockets 55.

Preferential performances are obtained by inserting the capacitive cable adapter of the invention between the two to-be-connected electrical devices either as described in FIG. 2 or as described in FIG. 3, and electrical continuity over the cable (31) shield between the local ground potentials is removed at low frequencies, i.e. industrial frequencies, thereby complying with safety requirements. At high frequencies (above 1 MHz) the electrical continuity over the cable is restored and the overall shielding effect of the connecting cable shield is substantially preserved, thereby ensuring efficient RFI prevention. The inventors have carried out some experiments that illustrate the efficiency of the capacitive cable adapter (hereinafter now referred to as CCA) of the invention with regard to RFI prevention. Several tests were performed using a tracking generator and a BNC cable in order to test the shield of the cable when the CCA is operative.

The experiments were performed as follows:

a tracking generator connects one end of a BNC cable under test, via a female-female CCA, the other end of the BNC cable is loaded with a 50 Ohm resistive load. Then, the behavior (i.e. RFI) of the shield is estimated by measuring the common mode current flowing over the cable shield by using a current probe.

Three successive tests were made:

1. In this experiment, the CCA is not used, the BNC cable connects directly the tracking generator but the cable shield is mechanically disconnected from the cable connector that attaches to the tracking generator, the other end of the cable attaches a 50 Ohm resistive load. As the shield is interrupted, the shielding effect is ruined and accordingly the RFI should be very important. This is the worst case. In this configuration the common mode current is measured.
2. In this second experiment, the configuration is the same as in test 1) but the cable shield is not disconnected. This is the best case configuration for RFI as the shield efficiency is optimum. In this configuration the common mode current is measured.
3. In this last experiment, the CCA is interposed between the tracking generator and the BNC cable. Three CCAs are successively used: a first one comprising one capacitor of 0.1 microFarad (F), a second one comprising two 0.1 F capacitors, and a third one comprising three 0.1 F capacitors. In this configuration the common mode current is measured.

Figure 5:
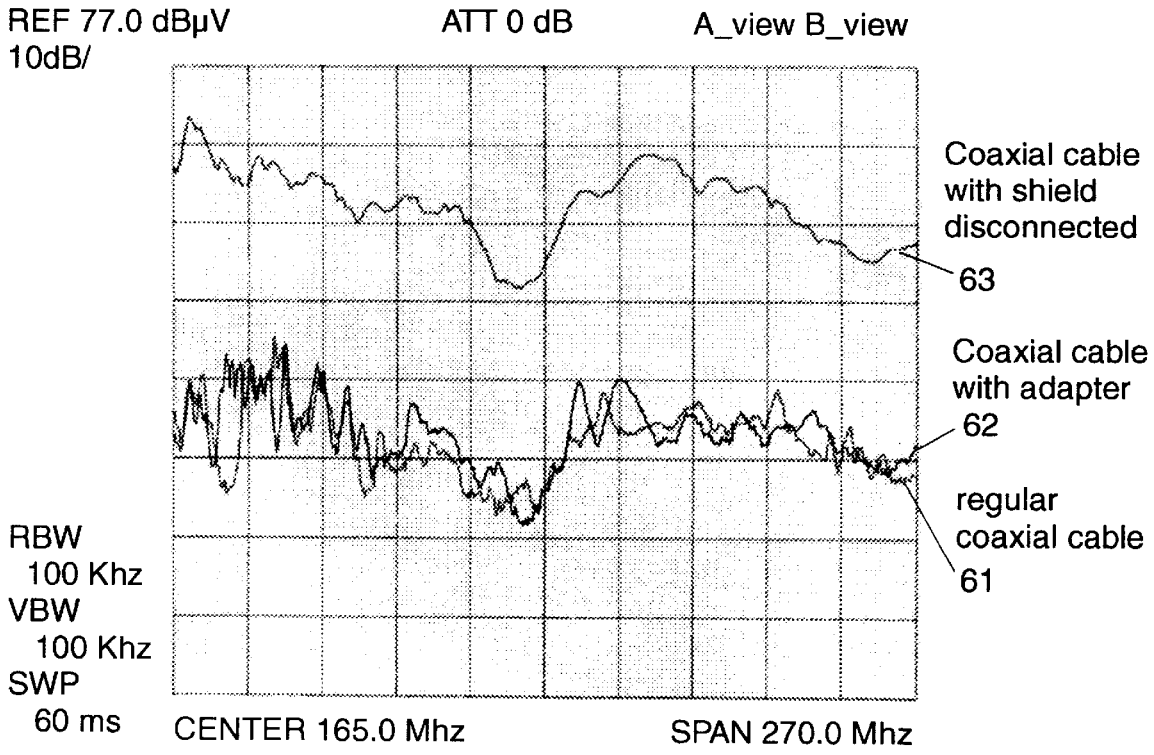
FIG. 5 shows curves obtained from performance measurements when using or not the capacitive cable adapter of the present invention. These drawings are not intended as a definition of the invention, but are provided solely for the purpose of illustrating the preferred embodiments of the invention described below.

The results obtained were as follows. Taking as reference the common mode current measured in configuration 1) above ("worst case"), using the CCA that comprises one capacitor provides a reduction of the CMC which is at minimum of 20 decibel (dB) for a frequencies range of 10 MHz to several hundreds of MHZ. Using the CCA that comprises two capacitors provides additional common mode current reduction of about 5 dB. Finally, using the CCA that comprises three capacitors still provides additional common mode current reduction but it is not significant. In FIG. 5, there is shown a graphic representation of curves (frequencies, common mode current intensity) obtained from measurements under each of the conditions defined in cases 1), 2), 3) above. Curve 61 was obtained from measurements with the cable without CCA (conditions 2), "best case"), and curve 62 was obtained with the cable having the CCA interposed (conditions 3). One can observe that curves 61 and 62 are very close in average. Still in FIG. 5, curve 63 corresponds to case 1) (worst case: cable shield interrupted). Comparing these curves, one can observe that the common mode current intensity corresponding to curve 63, is higher of about 30 dB in average, than common mode current intensity of curves 62 (with the adapter) and 63.

Therefore, the performances in terms of shielding efficiency, obtained using the capacitive cable adapter of the invention are very satisfactory and substantially better than those obtained when using prior art solutions.

The inventors believe that the shield effect provided by the cable is preserved by the capacitive cable adapter of the invention, due to the specific arrangement of the capacitors which substantially ensure the shield continuity, and consequently avoid the degradation of the shield effect that is typically observed in case of shield interruption.

While the invention has been described in terms of a preferred embodiment, those skilled in the art will recognize that the invention can be practiced with variations and modifications. Therefore, it is intended that the appended claims shall be construed to include both preferred embodiment and all variations and modifications thereof that fall within the scope of the invention.

What is claimed is:

1. A capacitive cable adapter for being interposed between at least two electrical devices interconnected via a shielded cable comprises:

two shielded electrical connectors aligned back-to-back with an internal pin-to-pin connection, each of which electrical connectors has an outer shield with the outer shield of each of the two connectors being interrupted approximately at mid distance between the ends of the two connectors, thereby forming a gap between the shields of the two connectors; and a predefined number of capacitive components arranged around the two connectors such that, one of the two pins of each capacitor is connected to the shield of one of the two connectors, and the other pin of said each capacitor is connected to the shield of the other connector, thereby connecting over the gap the outer shields of the two connectors.

2. The capacitive cable adapter as defined in claim 1, wherein the two shielded connectors are female connectors.

3. The capacitive cable adapter as defined in claim 1, wherein the two shielded connectors comprise a male connector and a female connector.

4. The capacitive cable adapter as defined in claim 1, wherein the two shielded electrical connectors are BNC type connectors.

5. The capacitive cable adapter as defined in claim 1, wherein the two shielded electrical connectors are DB type connectors.

6. The capacitive cable adapter as defined in claim 2, wherein the two shielded electrical connectors are DB type connectors.

7. The capacitive cable adapter as defined in claim 3, wherein the two shielded electrical connectors are DB type connectors.

8. The capacitive cable adapter as defined in claim 4, wherein the capacitive components are soldered Surface Mounted Technology (SMT) capacitors.

9. The capacitive cable adapter as defined in claim 5, wherein the capacitive components are soldered Surface Mounted Technology (SMT) capacitors.

10. The capacitive cable adapter as defined in claim 8, comprising at least 2 and preferably 4 SMT capacitors which values are in the range of 10 to 100 nanoFarad.

11. The capacitive cable adapter as defined in claim 1, wherein the capacitive cable adapter is interposed between two shielded cables respectively attached at their other end to a first and a second electrical device.

12. The capacitive cable adapter as defined in claim 1, wherein the capacitive cable adapter is interposed between a first connector attached to a first electrical device and a second connector which terminates a shielded cable attached at its other end to a second electrical device.

* * * * *